United States Patent [19]

Shrock et al.

[11] Patent Number: 4,563,784

[45] Date of Patent: Jan. 14, 1986

[54] POWER ACTUATED SEAT-BED ASSEMBLY

[75] Inventors: Fred J. Shrock, P.O. Box 4022, Elkhart, Ind. 46515; Harley Berkey, Elkhart, Ind.

[73] Assignee: Fred Shrock, Elkhart, Ind.

[21] Appl. No.: 641,728

[22] Filed: Aug. 17, 1984

[51] Int. Cl.[4] ..... A47C 17/16; A47C 17/17

[52] U.S. Cl. ..... 5/37 R; 5/47; 5/18 R; 5/58; 297/342

[58] Field of Search ..... 5/37 R, 37 B, 37 C, 5/44 R, 47, 18 R, 18 B, 17, 58; 297/342, 330

[56] References Cited

U.S. PATENT DOCUMENTS

| | | | |
|---|---|---|---|
| 3,064,276 | 11/1962 | Newsom | 5/17 |
| 3,458,877 | 8/1969 | Edwards | 5/47 |
| 4,321,716 | 3/1982 | Shrock | 5/18 R |
| 4,361,917 | 12/1982 | Wilson | 5/68 |
| 4,407,030 | 10/1983 | Elliott | 5/69 |
| 4,505,514 | 3/1985 | Stockl et al. | 297/342 |

*Primary Examiner*—Alexander Grosz
*Attorney, Agent, or Firm*—James D. Hall

[57] ABSTRACT

An improved seat-bed assembly which includes seat and back supports associated with a linkage and a motor to convert the assembly from seat form to a bed. The seat support may be raised when in the seat position to allow articles to be stored beneath the seat support.

4 Claims, 7 Drawing Figures

POWER ACTUATED SEAT-BED ASSEMBLY

SUMMARY OF THE INVENTION

This invention relates to an improved convertible seat-bed assembly, and will have special application to a power driven convertible seat which includes storage provisions beneath the assembly seat support.

The seat-bed assembly embodied in this invention is principally adapted for use in a vehicle such as a camper or van. Heretofore, seat-bed assemblies were manually convertible from a seating position to a bed position. Such as prior construction is shown in U.S. Pat. No. 4,321,716, which is incorporated herein by reference.

The seat-bed assembly of this invention utilizes a gear mechanism connected to a power motor which upon activation urges the assembly into a selected one of its seat or bed positions. Also, the seat frame support may be lifted when the assembly is in the seat position to allow article storage beneath the seat support within the assembly.

Accordingly, it is an object of this invention to provide for a motorized convertible seat-bed assembly.

Another object of this invention is to provide a motorized seat-bed assembly which includes storage provisions beneath the assembly seat support.

Another object of this invention is to provide for a motorized seat-bed assembly which can be rapidly and easily converted from a seat to a twin sized bed.

Still another object of this invention is to provide for a motorized seat-bed assembly which is lightweight, durable and economical.

Other objects of this invention will become apparent upon a reading of the following description.

BRIEF DESCRIPTION OF THE DRAWINGS

A preferred embodiment of the invention has been chosen for purposes of illustration wherein.

DESCRIPTION OF THE PREFERRED EMBODIMENT

Figure 1:
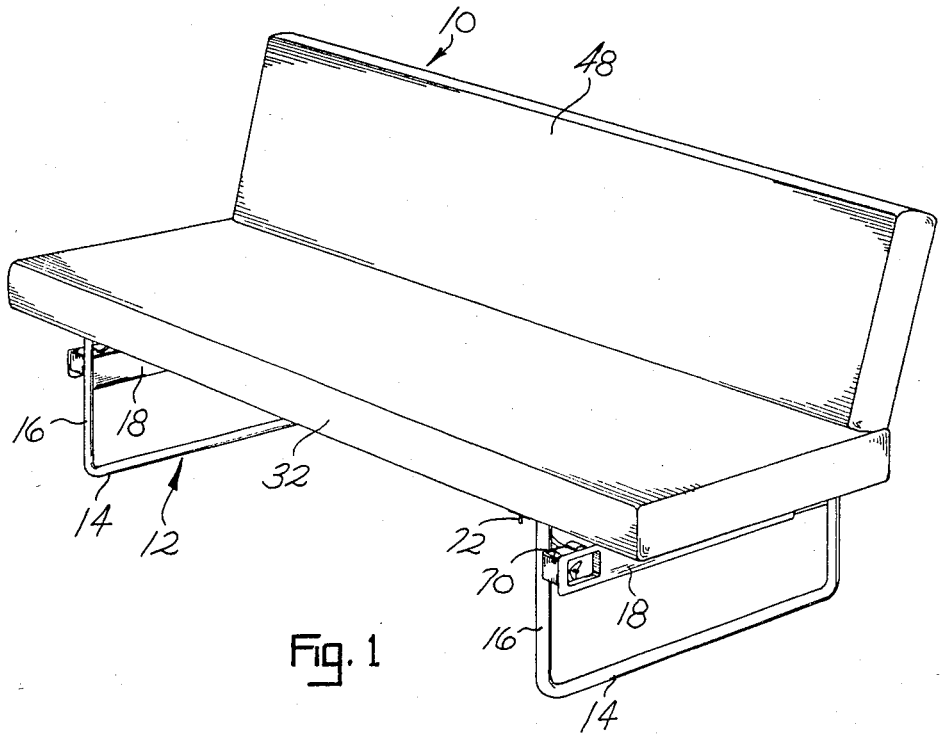
FIG. 1 is a perspective view of the seat-bed assembly in its seat position.
Figure 2:
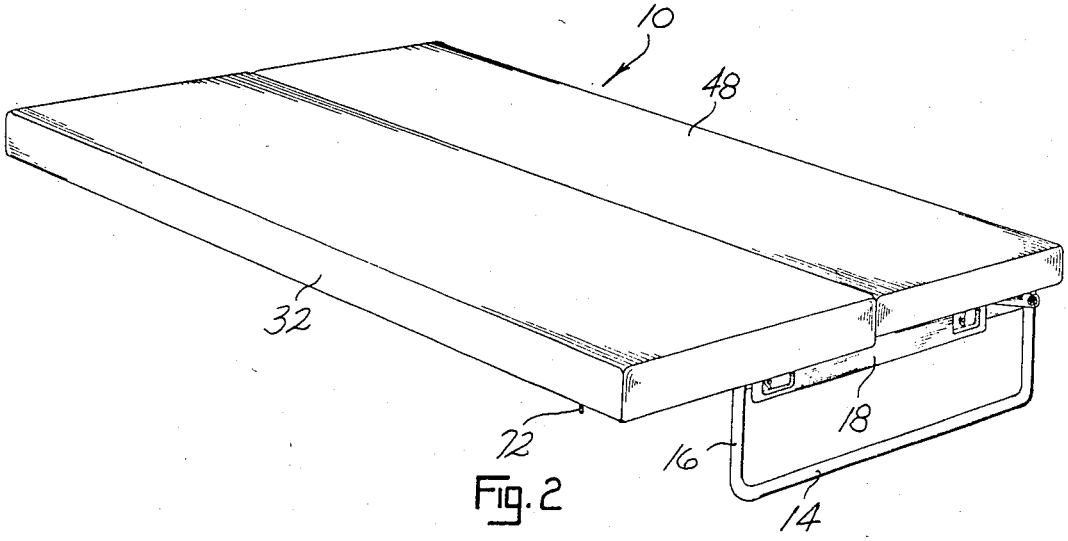
FIG. 2 is a perspective view of the seat-bed assembly in its bed position.

The preferred embodiment herein described is not intended to be exhaustive or to limit the invention to the precise form disclosed. It is chosen and described to explain the principles of the invention and its application and practical use to thereby enable others skilled in the art to utilize the invention.

The seat-bed assembly 10 shown in the drawings includes a base frame 12 formed of spaced U-shaped end members 14. End members 14 are connected by longitudinal cross members 15 which extend the length of assembly 10. Each end member 14 includes vertical legs 16 between which a support 18 extends. Guide channels

20 and 22, as shown in FIGS. 3–6, are positioned on each support 18. The connecting linkage for the seat and back frame supports extending from each end member 14 is the same and thus only one complete end member is shown and will be described. It is understood that the other end member 14 and its connecting linkage rest specifically described works and is constructed in similar fashion.

Seat support 26 includes a fixed link 24 which is slidably retained at its lower end 28 for movement along guide channel 20 by a roller 30 located within the guide channel. A bench type spring frame and seat cushion 32 is attached to support 26. A link 34 is pivotally connected at one end 36 to seat support 26 and is slidably retained for movement along guide channel 22 at its other end 38 by a roller (not shown) located within the guide channel.

A lazy tong-like linkage controls movement of a back frame support 40 and includes links 42, 44 and 46. A spring frame and back cushion 48 is attached to back support 40. One end 50 of link 42 is pivotally connected to end 38 of link 34 and is slidably retained for movement along guide channel 22 by being connected at its other end to link 34. Link 44 is pivotally connected at one end 52 to rear vertical leg 16 of end member 14 and is pivotally connected at its other end 54 to back support 40. Link 44 is also pivotally connected at 56 to link 42. Link 46 is pivotally connected at one end 58 to link 42 and is pivotally connected at the other end 60 to back support 40. The assembly as thus far described is similar to the seat-bed assembly disclosed in U.S. Pat. No. 4,321,716.

Figure 3:
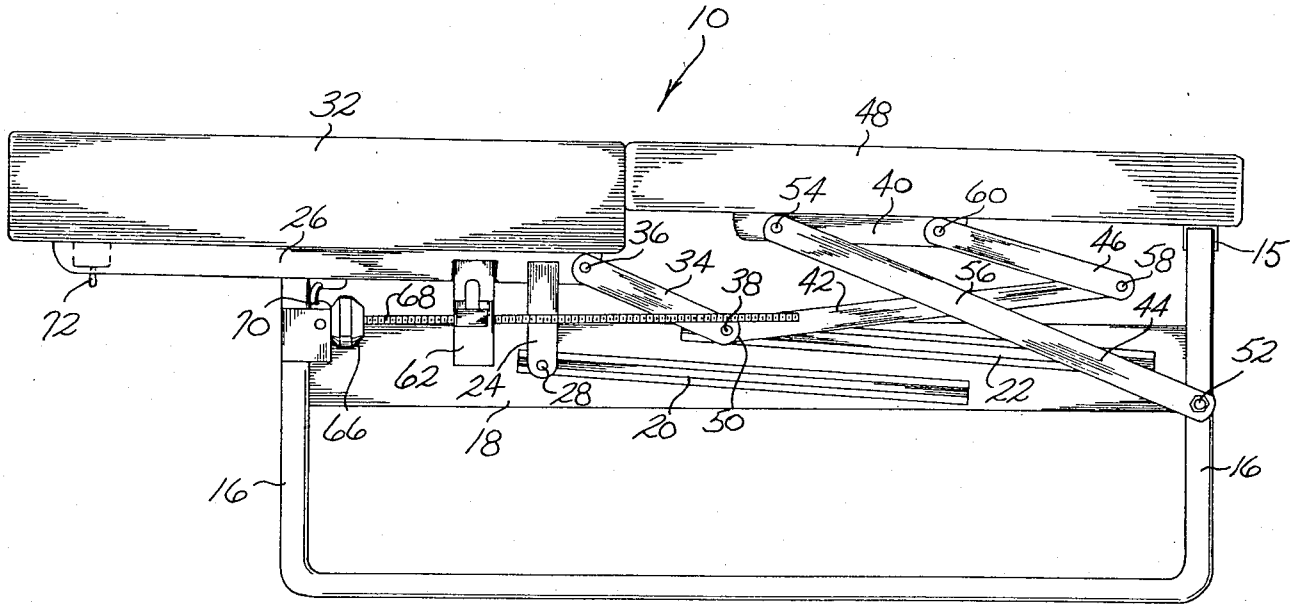
FIG. 3 is a side elevational view of the assembly in its bed position.
Figure 5:
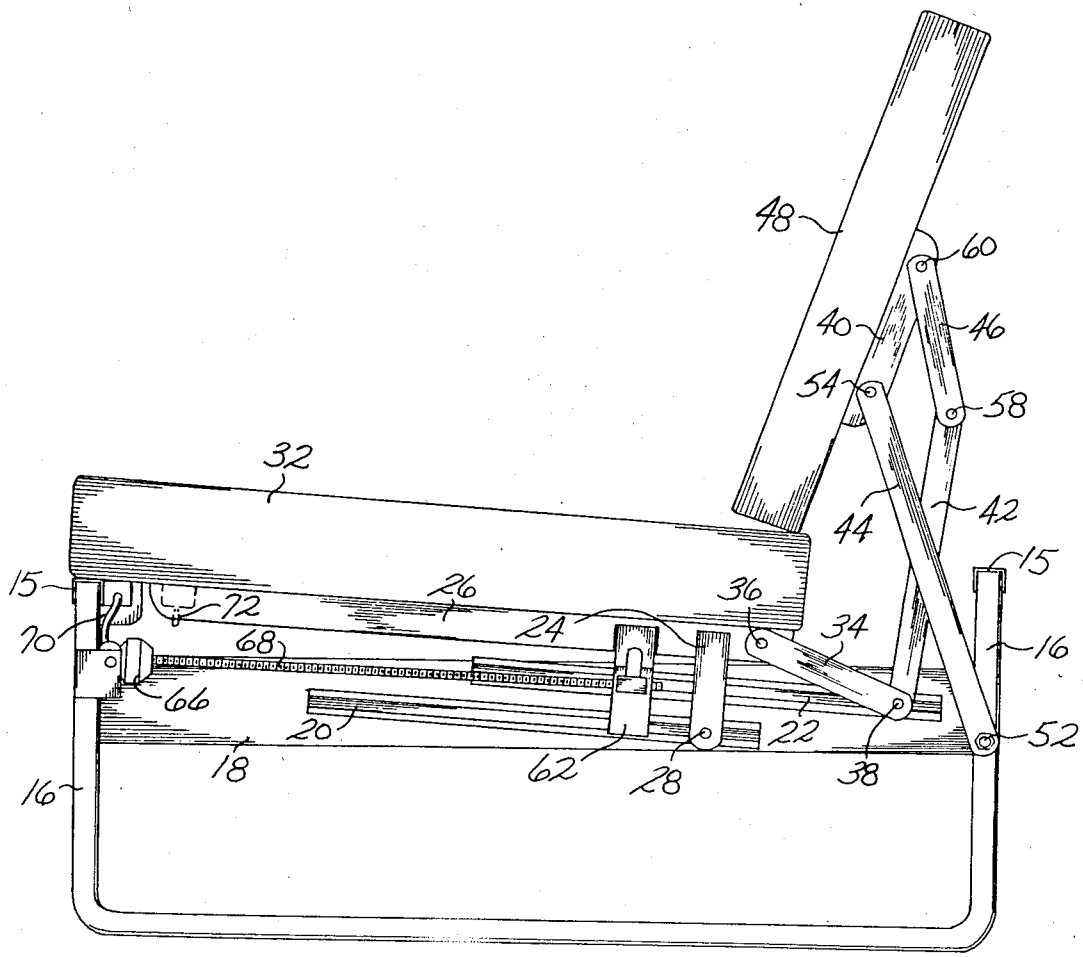
FIG. 5 is a side elevational view of the assembly in its seat position.

Assembly 10 includes a mechanized device attached to one end member 14 and its connecting linkage for shifting the assembly between the seat position of FIG. 3 to the bed position of FIG. 5. A bracket 62 is joined to seat support 26 in front of link 34. A threaded sleeve 63 is pivotally connected to bracket 62. A gear box 66 is attached to support leg 16 and supports a worm gear 68 which extends through sleeve 63. A battery operated motor 70 is connected through reduction gears within gear box 66 to worm gear 68. A spring biased switch 72 is associated with motor 70 to allow for motor actuation and the resulting rotation of gear 68. Switch 72 is located at one side of cushion 32 for ease of accessibility.

Figure 4:
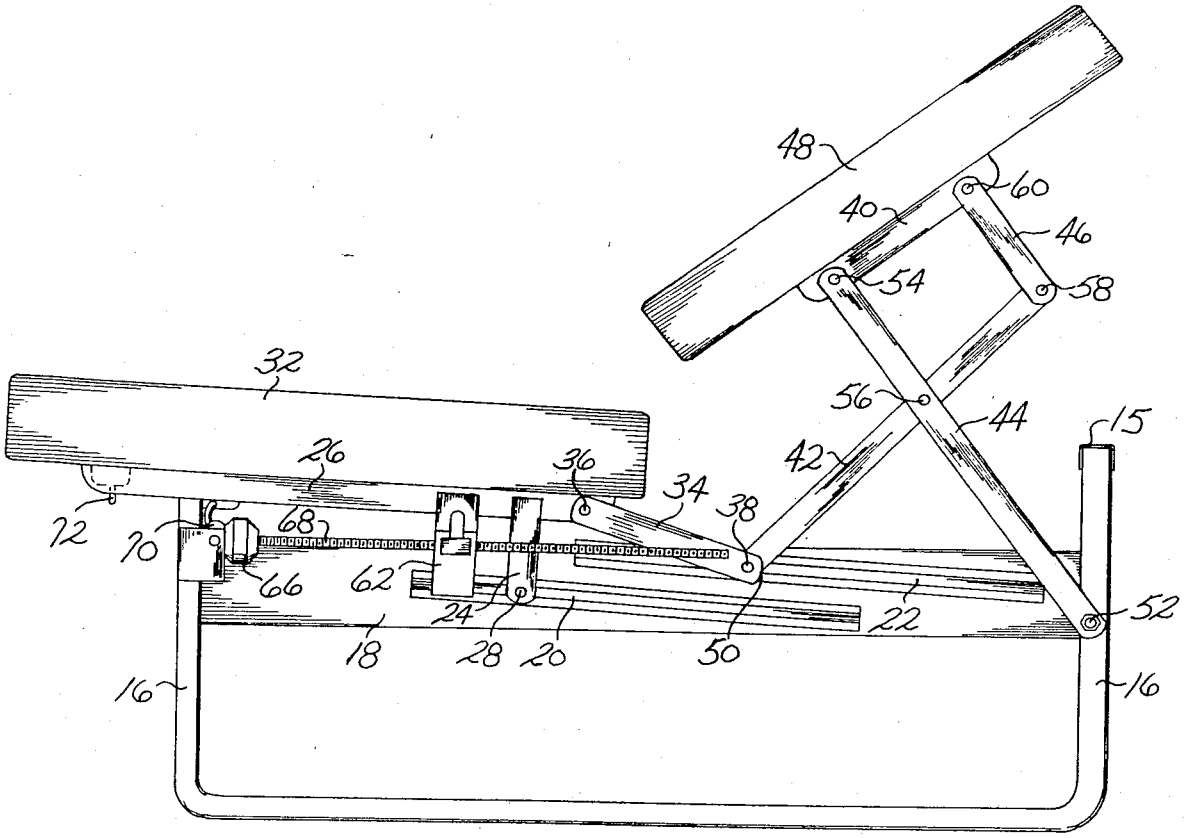
FIG. 4 is a side elevational view of the assembly in an intermediate position.

Assembly 10 is operated as follows. With assembly 10 in its seat position of FIG. 5, switch 72 is moved in one direction and held to activate motor 70. Upon activation of motor 70, gear 68 rotates within sleeve 63, causing movement of bracket 62 towards gear box 66. This pulls seat cushion 32 forward and back cushion 48 downward as shown in FIG. 4 until the bed position of FIG. 3 is reached and further movement is prevented. At this time motor switch 72 is released. To restore assembly 10 to the seat position, switch 72 is moved in the opposite direction and held to reverse motor 70 and gear 68 which pushes seat cushion 32 rearwardly until the assembly 10 is in its seat position of FIG. 5 where switch 72 is released to stop the motor.

Figure 6:
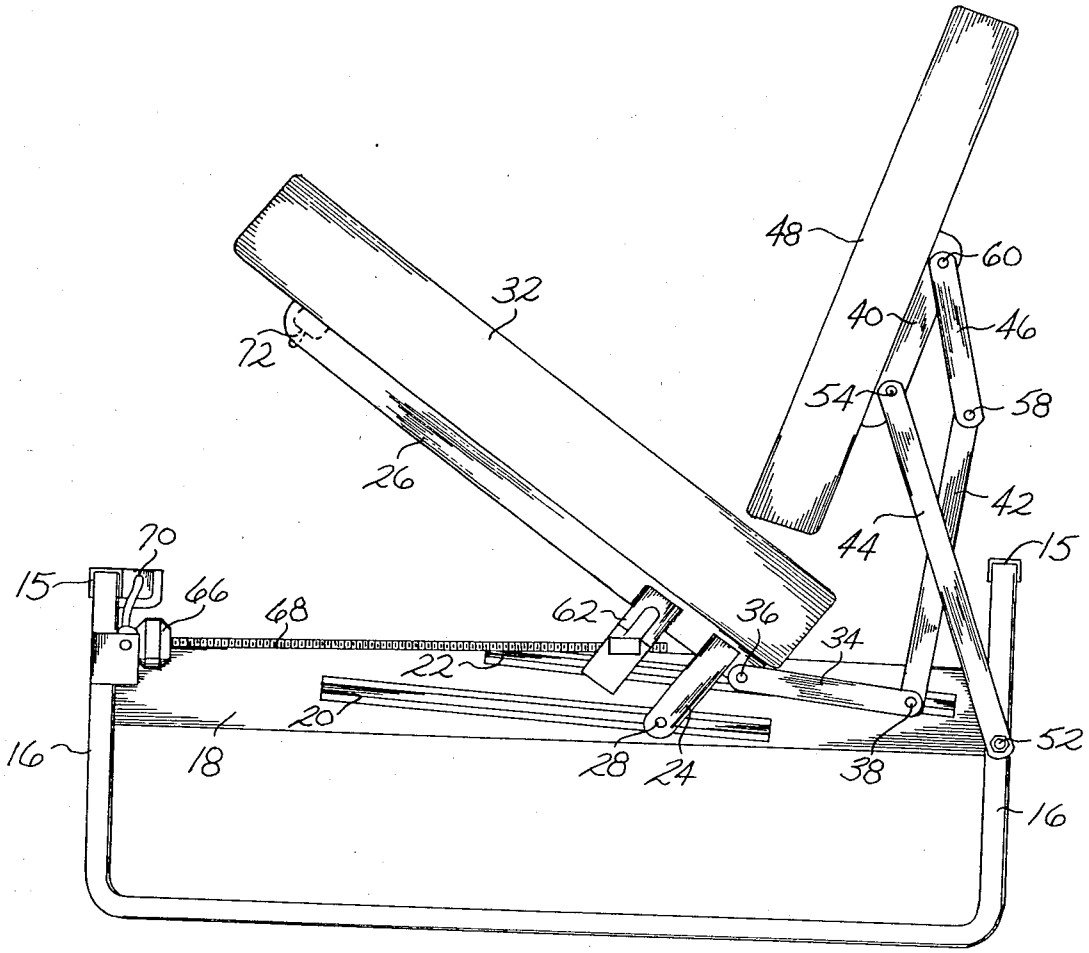
FIG. 6 is a side elevational view of the assembly in its seat position with the seat frame support lifted to expose the storage area beneath the seat support.
Figure 7:
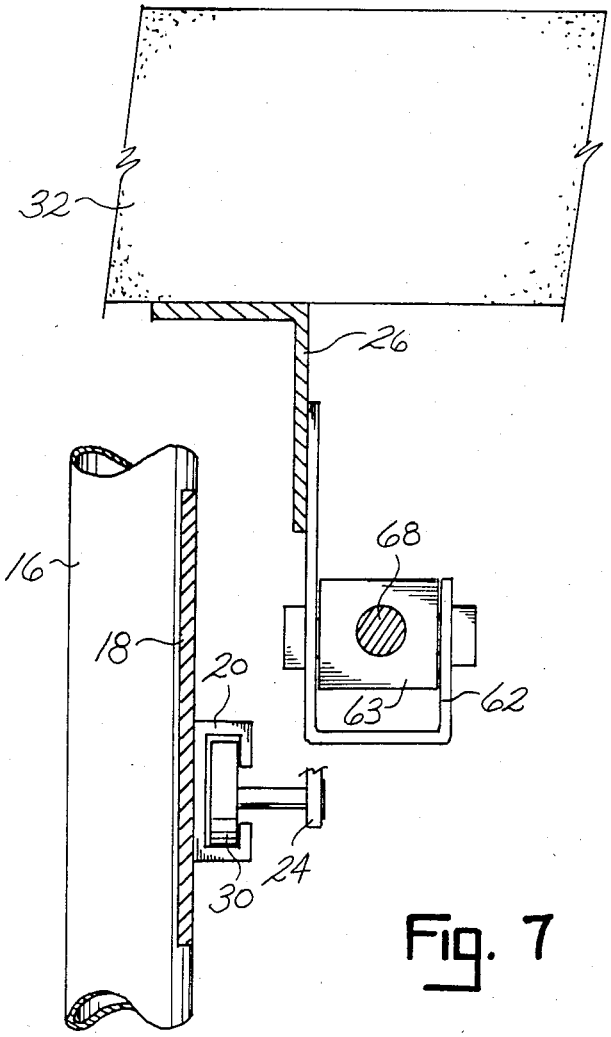
FIG. 7 is a fragmentary cross-sectional view of the drive mechanism of the seat-bed assembly.

Also, due to the pivotal action of sleeve 63 and links 24 and 34, seat support 26 may be movably raised as shown in FIG. 6, allowing items to be stored beneath the seat support.

It is to be understood that the scope of the invention is not limited to the above description, but may be modified within the scope of the appended claims.

We claim:

1. In a convertible seat-bed assembly comprising a base frame, a seat support, and a back support, linkage means connected between said frame and seat and back supports for supporting the seat and back supports for movement between a seat position wherein the seat support is generally horizonal and the back support is generally vertical, the improvement comprising motor means associated with said seat support and independent of said linkage means for urging said seat and back support into a selected one of their said seat and bed positions, wherein a threaded sleeve is pivotally connected to a bracket, which in turn is connected to said seat support, and a gear is associated with said bracket and motor means, said gear threaded within said sleeve and constituting means for shifting said seat support into a selected one of its said seat and bed positions, said sleeve pivotal connection constituting means for allowing said seat support to be raised upwardly when in its said seat position from its front towards said back support, said frame including first and second spaced frame end members whereby raising said seat support when in its seat position exposes a space between said frame and members.

2. The seat-bed assembly of claim 1 wherein said motor means is an electrically powered motor.

3. The seat-bed assembly of claim 2 and manually operable switch means for activating said motor.

4. The seat-bed assembly of claim 1 wherein said motor means is positioned adjacent a side edge of said frame.

* * * * *